US006644392B2

(12) United States Patent
Kalbascher

(10) Patent No.: US 6,644,392 B2
(45) Date of Patent: Nov. 11, 2003

(54) HEAT EXCHANGER AND A METHOD OF MANUFACTURING A HEAT EXCHANGER

(75) Inventor: Klaus Kalbascher, Rangendingen (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/190,091

(22) Filed: Jul. 3, 2002

(65) Prior Publication Data

US 2003/0006028 A1 Jan. 9, 2003

(30) Foreign Application Priority Data

Jul. 5, 2001 (DE) ..... 101 32 617

(51) Int. Cl.[7] ..... F28F 9/02

(52) U.S. Cl. ..... 165/173; 165/175; 228/183; 29/890.032

(58) Field of Search ..... 165/173, 175, 165/474; 228/183; 29/890.052

(56) References Cited

U.S. PATENT DOCUMENTS

| | | | | | |
|---|---|---|---|---|---|
| 2,164,628 | A | * | 7/1939 | Sibley | 165/175 |
| 2,539,701 | A | * | 1/1951 | Przyborowski | 165/173 |
| 3,326,279 | A | * | 6/1967 | Eisberg et al. | 165/176 |
| 3,583,478 | A | | 6/1971 | Fieni | |
| 3,724,537 | A | * | 4/1973 | Johnson | 165/173 |
| 4,582,127 | A | * | 4/1986 | Moranne | 165/173 |
| 5,101,561 | A | * | 4/1992 | Fuhrmann et al. | 29/890.043 |
| 5,535,821 | A | * | 7/1996 | Potier | 165/175 |
| 5,758,721 | A | * | 6/1998 | Letrange et al. | 165/173 |
| 6,296,051 | B1 | * | 10/2001 | Sahnoun et al. | 165/173 |

FOREIGN PATENT DOCUMENTS

| | | | | |
|---|---|---|---|---|
| DE | 24 35 736 A1 | | 3/1975 | |
| DE | 31 41 580 A1 | | 8/1982 | |
| EP | 0 479 012 B1 | | 9/1991 | |
| FR | 2540614 A | * | 8/1984 | 165/176 |
| GB | 191175 | | 1/1928 | |
| GB | 7 90 704 | | 2/1958 | |

* cited by examiner

*Primary Examiner*—Terrell McKinnon
(74) *Attorney, Agent, or Firm*—Wood, Phillips, Katz, Clark & Mortimer

(57) ABSTRACT

A heat exchanger for enabling the flow of a heat exchanging medium disclosed. The heat exchanger comprises a collecting box having a peripheral edge; a tube bottom having a peripheral edge and a plurality of openings, the peripheral edge of the tube bottom being coupled to a peripheral edge of the collecting box; an intermediate bottom having a plurality of openings and a peripheral edge, the peripheral edge coupled to the peripheral edge of the tube bottom; and a plurality of flat tubes coupled to the plurality of openings in the intermediate bottom. A method of manufacturing a heat exchanger is also disclosed. The method comprising the steps of coupling a collecting box to a tube bottom; coupling an intermediate bottom to the tube bottom; and coupling a plurality of flat tubes to the intermediate bottom.

20 Claims, 4 Drawing Sheets

Fig. 2
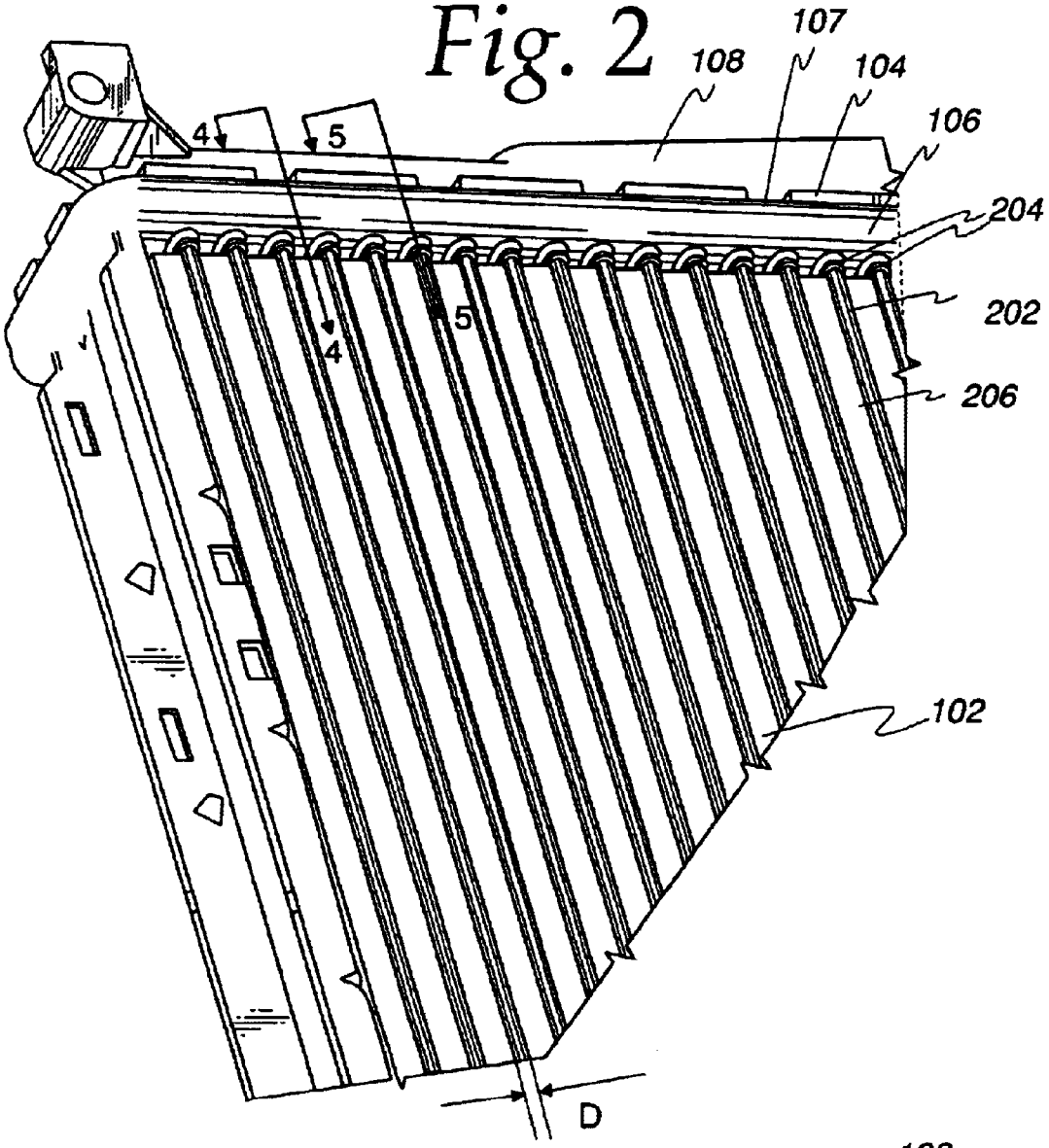
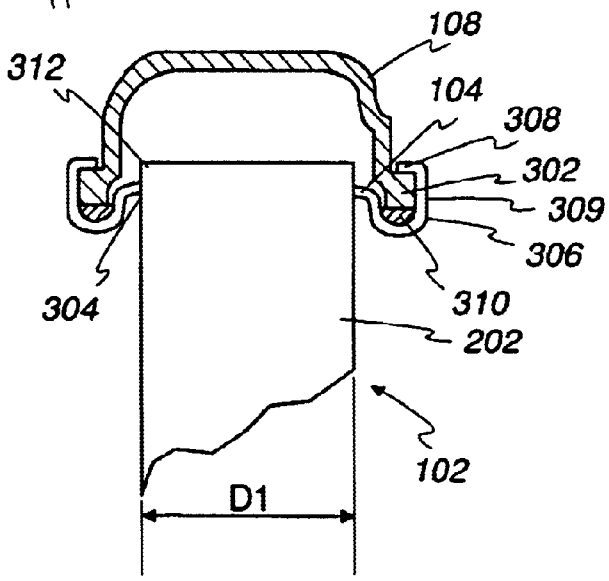
Fig. 3
Prior Art

HEAT EXCHANGER AND A METHOD OF MANUFACTURING A HEAT EXCHANGER

FIELD OF THE INVENTION

The present invention relates to a heat exchanger, and more particularly to a method of manufacturing a heat exchanger.

RELATED APPLICATIONS

This application claims priority to foreign application DE 101 32 617.3 filed Jul. 5, 2001 in Germany, the contents of which are incorporated in their entirety herein by reference.

BACKGROUND OF THE INVENTION

Heat exchangers having a construction as shown in EP 479 012 B1 suppress the expansion of the flat tubes caused by the internal pressure. However, such heat exchangers are expensive to produce. In particular, start up costs, including tooling, equipment, etc., necessary for large series manufacture, can be significant. Accordingly, the cost per heat exchanger increases if a limited number of heat exchangers are produced. Heat exchangers for vehicles are often designed for different cooling capacity, because customers demand vehicles of the same model with different engines. One solution for providing heat exchangers of roughly the same size, but with different cooling capacity, is to provide cooling grates with different depths. That is, flat tubes having a large major dimension are used for higher cooling capacity, while flat tubes having a smaller major dimension are used for more limited cooling capacity. However, this solution entails significant expense for new tooling and equipment. In particular, new tube bottoms and possibly even new collecting boxes, each requiring a new die, are required for each heat exchanger having a different capacity.

Accordingly, there is a need for an improved heat exchanger and method of manufacturing a heat exchanger.

SUMMARY OF THE INVENTION

The present invention enables the manufacturing of heat exchangers for a higher cooling capacity by employing a cooling grate of greater depth, while requiring only small modification and expense. Because the intermediate bottom of the heat exchangers of the present invention have an edge that is metallically joined to the peripheral edge of the tube bottom, and because the intermediate bottoms have one or more openings so that a space traversed by the heat-exchanging medium flowing through the flat tube is present between the intermediate bottoms and the corresponding tube bottom, it is possible, with limited modification expense, to make a heat exchanger having a cooling grate of greater depth, and therefore greater cooling capacity. The traversable space between the intermediate bottom and the tube bottom ensures compensation for the depth difference and for pressure differences over the length of the collecting box.

The intermediate bottom preferably has openings corresponding to the flat tube ends with passages, in order to be able to solder the flat tube ends in the passages, when the intermediate bottom is arranged beneath the corresponding tube bottom. Alternatively, the intermediate bottoms can have only one or a few openings provided with stiffening connectors when the intermediate bottom is arranged above the corresponding tube bottom.

Accordingly, the collecting boxes of the heat exchangers of the present invention with lower cooling power can be used without having to make any changes. The shaping tool for producing the tube bottom can also be used, in which no changes or only limited changes as explained below, are necessary. The only additional expense consists of preparing a die for the intermediate bottom. However, because the tolerances of the intermediate bottom are relatively minor, the required tooling expense is low. In any case, the degree of deformation of the intermediate bottom is more limited than that of the tube bottom, which also contributes to relatively low tooling costs of the intermediate bottom. The invention therefore makes it possible to lay out the dies and equipment for large series production.

Since the vehicles in a vehicle model with a lower engine power and cooling demands are often the ones that are produced in the largest numbers, the dies can be specfically made to the components required for them. For example, a heat exchanger could be made for a vehicle having a cooling grate depth of approximately 30 mm, which corresponds roughly to the major dimension of the flat tube of the cooling grate. For vehicles of the same model, but with greater engine power, more high performance heat exchangers are required in smaller numbers, and could have a cooling grate depth of approximately 40 mm.

BRIEF DESCRIPTION OF THE DRAWINGS

FIG. 2 is an enlarged detail of a portion of the heat exchanger of FIG. 1;

FIG. 3 is a partial cross section of a conventional heat exchanger;

DESCRIPTION OF THE PREFERRED EMBODIMENTS

Figure 1:
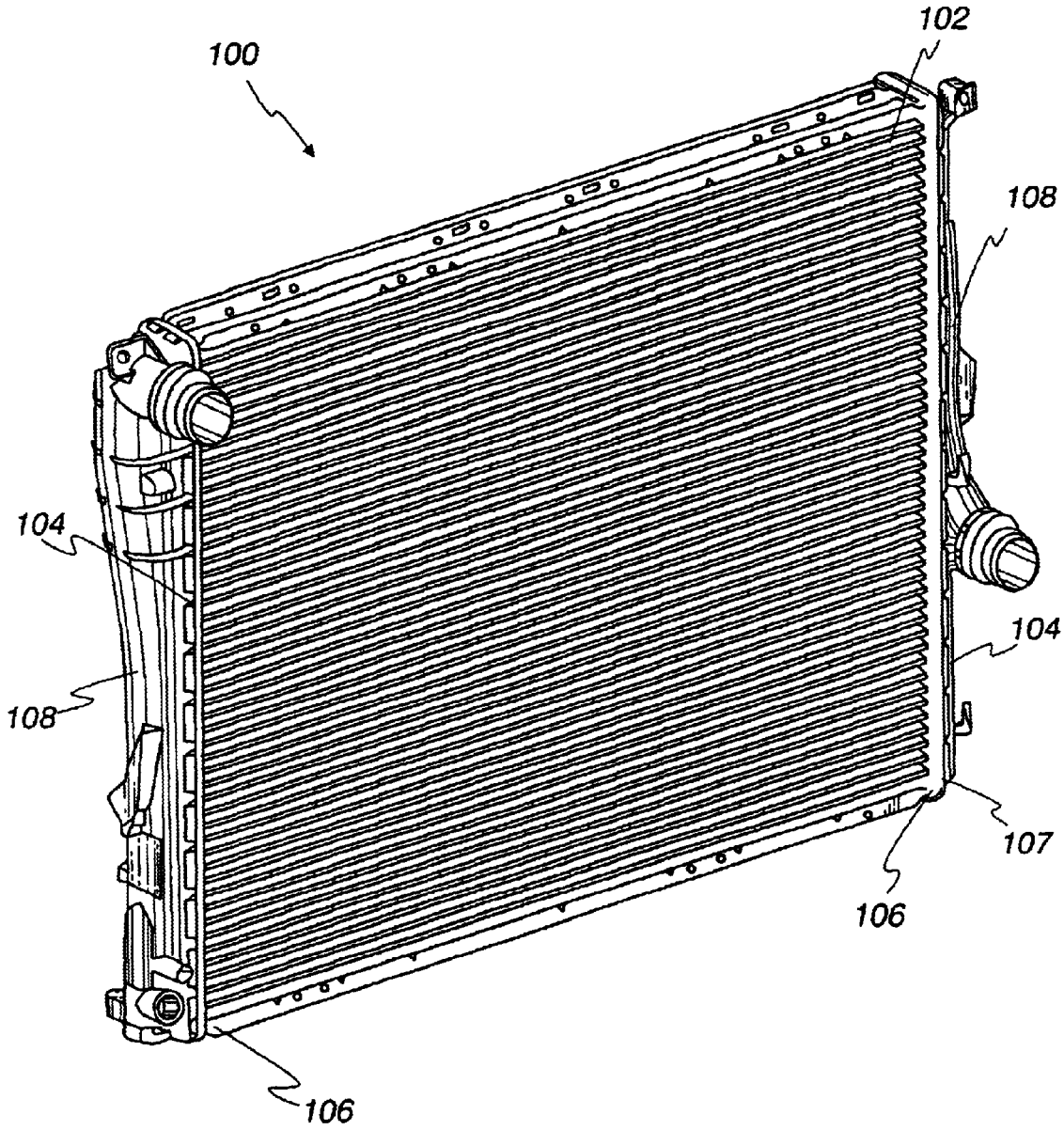
FIG. 1 is a perspective view of a heat exchanger.

Turning now to FIGS. 1 and 2, a heat exchanger 100 comprises a cooling grate 102 coupled to a tube bottom 104 by way of an intermediate bottom 106 at a peripheral edge 107. A collecting box 108 is coupled to the tube bottom 104. As shown in the expanded view of FIG. 2, the cooling grate 102 comprises a plurality of flat tubes 202 coupled to a plurality of passages 204 with corrugated fins 206 inserted in between. The heat exchanger 100 is the air-coolant cooler of a vehicle, in which the cooling air flows through the corrugated fins 206 and the cooling liquid through the flat tubes 202. The collecting boxes 108 are made of plastic, but could be made of aluminum or any other suitable material, and are produced in large numbers in a relatively expensive injection molding die.

Turning now to FIG. 3, a conventional heat exchanger having tubes 202 of the cooling grate 102 which are soldered to the tube bottom 104 is shown. A peripheral edge 302 of the collecting box 108 is inserted into a trough 306 of the peripheral edge 308 of the tube bottom 104. A seal 310 is provided in the trough 306 of the tube bottom 104. The peripheral edge 308 of the tube bottom 104 secures the collecting box 108 to the tube bottom 104. The bending of the peripheral edge 308 of the tube bottom 104 is carried out in a special die, in which a firm and liquid-tight joint is produced with the collecting box 108. Finally, the ends 312 of the flat tubes 202 extend into the corresponding openings 304 in tube bottom 104 and are soldered therein. The major dimension $D_1$ of the flat tube 202 could be 30 mm for example, which corresponds to the depth of the cooling grate 102.

Figure 4:
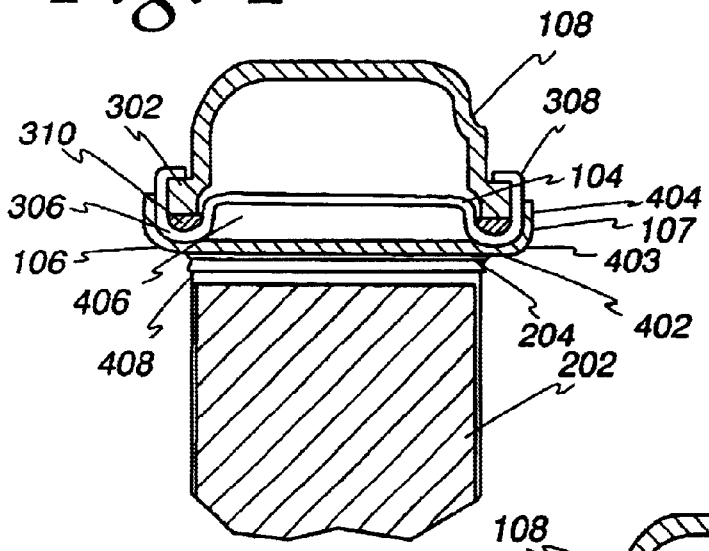
FIG. 4 is a partial cross section of the heat exchanger of FIG. 2 taken at lines 4—4 according to a first embodiment of the present invention.
Figure 5:
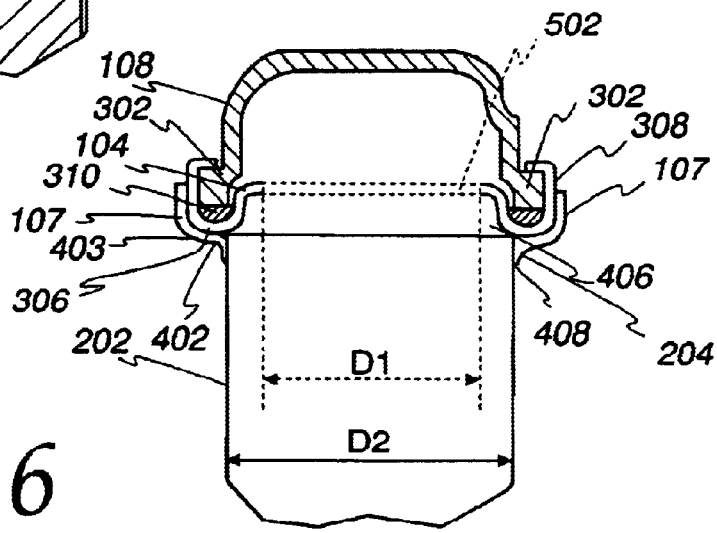
FIG. 5 is a partial cross section of the heat exchanger of FIG. 2 taken at lines 5—5 according to the first embodiment of the present invention.

Turning now to FIGS. 4–7, cross sections of a heat exchanger 100 according to the present invention show the use of the flat tubes 102 with a greater major dimension $D_2$ than the major dimension $D_1$ with a very limited modification expense. In order to configure the heat exchanger with a deeper, more powerful cooling grate using the existing tube bottom 104, which is also produced with a costly die, the peripheral edge 107 of the intermediate bottom 106 is preferably metallically joined to the peripheral edge 308 of the tube bottom 104. The intermediate bottom 106 according to one embodiment is arranged beneath tube bottom 104, i.e., between the tube bottom 104 and the cooling grate 102. Each intermediate bottom 106 in the various embodiments of the present invention is a drawn part. However, high tolerances are not required, except for the passages 204. The intermediate bottom 106 need only have an appropriate peripheral edge, in order to be able to be soldered to the peripheral edge 308 of the tube bottom 104. For example, the vertical portion 404 on intermediate bottom 106 as shown in FIGS. 4 and 5 can essentially be omitted so that the peripheral edge 402 of the intermediate bottom 106 only lies against the peripheral edge 308 on the bottom, but not on the side, and is soldered to it. The intermediate bottom 106, except for passages 204, can therefore be an essentially flat part. Accordingly, the intermediate bottom 106 and the die to produce the intermediate bottom 106 can be produced relatively cheaply.

Referring specifically to FIGS. 4 and 5, cross sections through the collecting box 108 of FIGS. 1 and 2, including the tube bottom 104 and the intermediate bottom 106, are shown. The cross section of FIG. 4 taken at lines 4—4 lies between the flat tube 202, so that the passages 204 directed toward the cooling grate 102 are apparent. As shown, the peripheral edge 402 comprises a bend 403 extending to a vertical portion 404. The ends of the flat tubes 202 are inserted in the openings 408 surrounded by the passages 204 and soldered when in place. Because the cross section in FIG. 5 is taken at lines 5—5 in a flat tube 202, the corresponding passage 204 that encloses the opening 408 is also apparent.

A space 406 is provided between the intermediate bottom 106 and the tube bottom 104, and enables the transition or equalization between the originally more limited cooling grate depth to the enlarged cooling grate depth. The space 406 is occupied by the cooling liquid. It is understood that this space 406 extends roughly over the length of the collecting box 108 or the tube bottom 104. Because the edges 306 and 106, are continuous, they enclose the periphery the of tube bottom 104 and the intermediate bottom 106. The tube bottom 104 can remain fully unaltered in the embodiments of the present invention. However, if the die for producing the tube bottom 104 is a multistage sequential die, the insert, which is provided as a hole-passage punch, can be removed from the sequential die without great expense and replaced by a simple hole die, so that the series of openings 408 in the tube bottom 104 is only present as one or a few openings 408 in the tube bottom 104, in order to allow the heat exchanging medium to pass through. Whether such a change in the tube bottom die is necessary will depend on whether a somewhat higher pressure loss can be tolerated.

Figure 6:
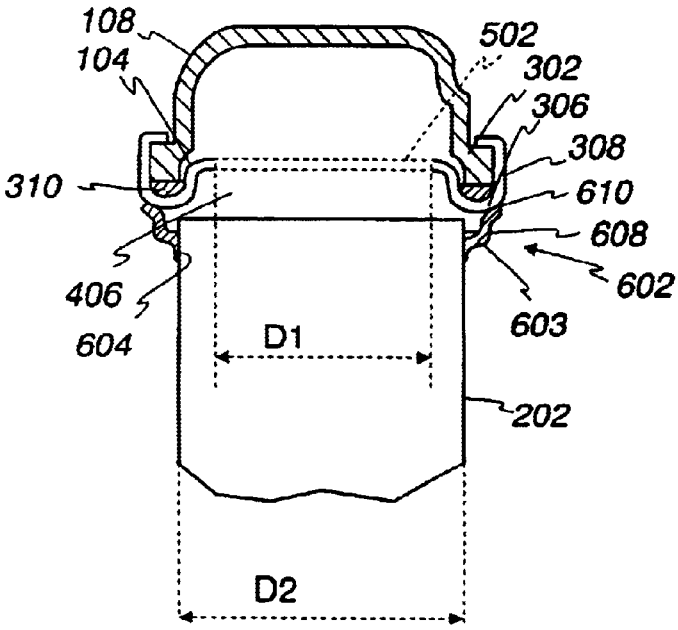
FIG. 6 is a partial cross section of the heat exchanger of FIG. 2 taken at lines 5—5 according to an alternate embodiment of the present invention.

Turning now to the embodiment of FIG. 6, the vertical portion 404 of the edge 107 of the intermediate bottom 106 as shown in FIGS. 4 and 5 can essentially be omitted. Referring first to FIG. 6, the intermediate bottom 602 comprises a peripheral edge 603. The peripheral edge 603 of the intermediate bottom 602 only lies against and is soldered to the bottom of the peripheral edge 308 of the tube bottom 104, but not on the side. The intermediate bottom 602, except for the passages 604, can therefore be an essentially flat part.

Figure 7:
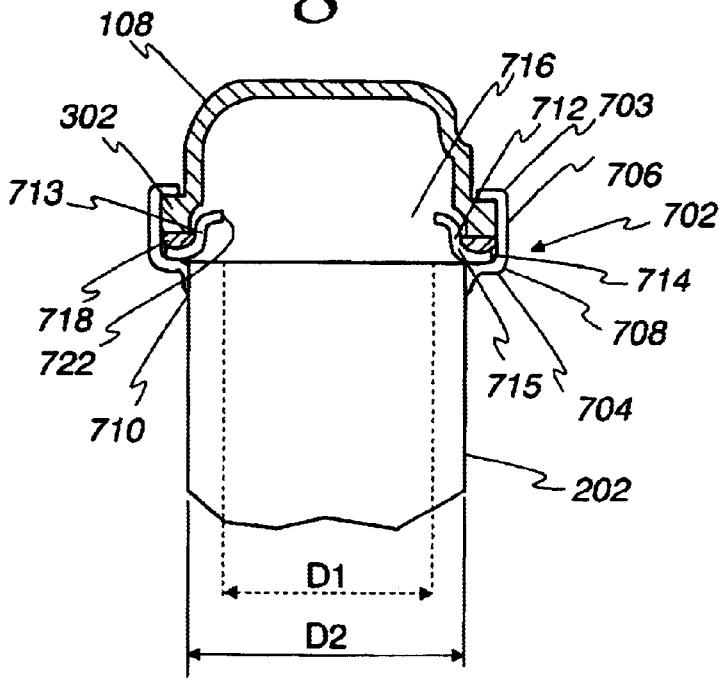
FIG. 7 is a partial cross section of the heat exchanger of FIG. 2 taken at lines 5—5 according to another alternate embodiment of the present invention.
Figure 8:
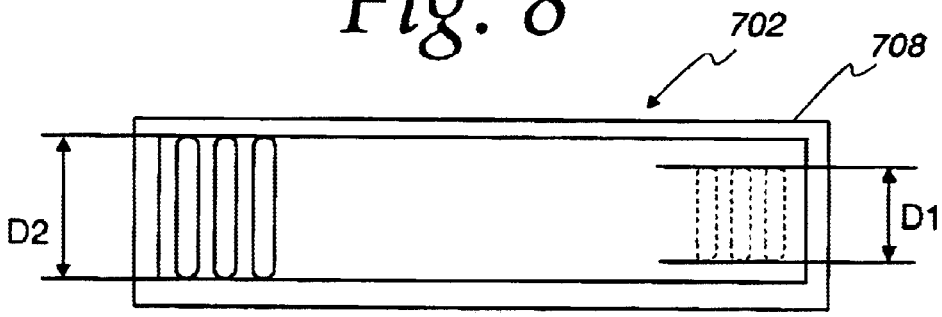
FIG. 8 is a somewhat diagramatic top view of the tube bottom of FIG. 7.
Figure 9:
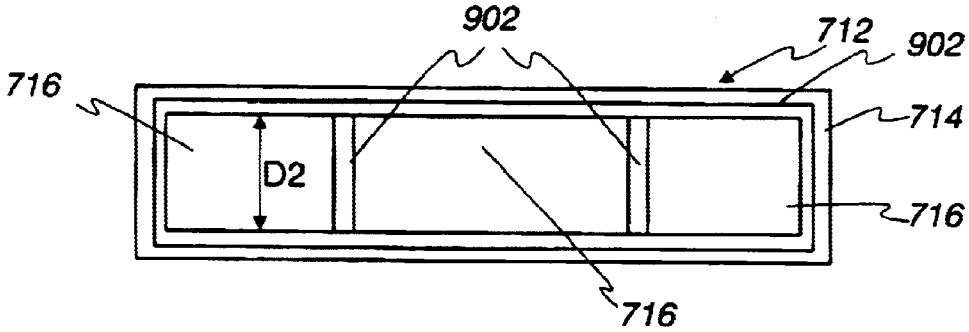
FIG. 9 is a somewhat diagramic top view of the intermediate bottom of FIG. 7.

Turning now to the embodiment shown in FIGS. 7, 8 and 9, an intermediate bottom is placed above the tube bottom. In particular, a tube bottom 702 comprises peripheral edge 708 having a bend portion 704 leading to a vertical portion 706. The tube bottom 702 further comprises a plurality of openings 710 for receiving the flat tubes 202. A intermediate bottom 712 comprises a ledge 714 on a peripheral edge 715 and openings 716. The edge 715 is positioned on the tube bottom 702 within the elbow portion 704. A seal 718 is formed between the ledge 714 and the elbow portion 704. More specifically, the intermediate bottom 712 of the embodiment of FIG. 7 is inserted with the peripheral edge 715 downward into the peripheral edge 703 of the tube bottom 702. Accordingly, the intermediate bottom 712 and its vertical edge 713 form an inner support for the seal 718. The clamping process of the collecting box 108 with its edge 302 within the elbow portion 704 of the tube bottom 702, which occurs after the soldering process, is therefore ensured and supported. A significant advantage of all the variants is that the outer contour of the tube bottom remains unaltered, and therefore the die for clamping can be used unaltered.

As shown in the top plan view of FIG. 8, the openings 710 of the tube bottom 702 having the large major dimension $D_2$ are shown on the left side. Although the entire tube bottom 104 comprises the openings 710 of a major dimension $D_2$, the openings 408 of a major dimension $D_1$ on the right side are shown in shadow for purposes of comparison. Accordingly, a tube bottom 702, which could have a size of 30 mm for example, could be replaced with a tube bottom 702 having a deeper dimension of 40 mm, for example. This is accomplished by replacing the above mentioned hole-passage punch for the openings 710, for example one with a size of 30 mm, in the sequential die with another unit with the larger dimension, for example one with the size of 40 mm.

As shown in the top plan view of FIG. 9, the openings 716, and the optional intermediate connectors 902, can be formed in the intermediate bottom 712, in order to allow the cooling liquid to flow through.

It can therefore be appreciated that a new and novel heat exchanger and method of manufacturing a heat exchanger has been described. It will be appreciated by those skilled in the art that, given the teaching herein, numerous alternatives and equivalents will be seen to exist which incorporate the disclosed invention. As a result, the invention is not to be limited by the foregoing embodiments, but only by the following claims.

What is claimed is:

1. A heat exchanger for enabling the flow of a heat exchanging medium, said heat exchanger comprising:

a collecting box having a peripheral edge;

a tube bottom having a trough receiving said collecting box, and a plurality of openings;

an intermediate bottom having a plurality of openings and a peripheral edge, said peripheral edge of said intermediate bottom coupled to a vertical portion of said trough of said tube bottom; and a plurality of flat tubes coupled to said plurality of openings in said intermediate bottom.

2. The heat exchanger of claim 1 wherein said intermediate bottom further comprises a plurality of passages adapted to receive said plurality of flat tubes.

3. The heat exchanger of claim 1 wherein said plurality of openings of said tube bottom are adapted to receive said plurality of flat tubes having a first major dimension wherein said plurality of openings of said intermediate bottom are adapted to receive a plurality of flat tubes having a second major dimension different from said first major dimension.

4. A heat exchanger for enabling the flow of a heat exchanging medium, said heat exchanger comprising:

a collecting box having a peripheral edge;

a tube bottom having a peripheral edge comprising a trough receiving said collecting box and a plurality of openings, said peripheral edge of said collecting box being coupled to a bottom of said trough;

an intermediate bottom having a plurality of openings and a peripheral edge coupled to the bottom of said peripheral edge of said trough; and a plurality of flat tubes coupled to said plurality of openings in said intermediate bottom.

5. The heat exchanger of claim 4 wherein said intermediate tube further comprises a plurality of passages adapted to receive said plurality of flat tubes.

6. The heat exchanger of claim 4 wherein said plurality of openings of said tube bottom are adapted to receive a plurality of flat tubes having a first major dimension and said plurality of openings of said intermediate bottom are adapted to receive a plurality of flat tubes having a second major dimension.

7. A heat exchanger for enabling the flow of a heat exchanging medium, said heat exchanger comprising:

a collecting box having a peripheral edge;

a tube bottom having a peripheral edge and a plurality of openings, said peripheral edge of said tube bottom being coupled to a peripheral edge of said collecting box;

an intermediate bottom having a plurality of openings and a peripheral edge, said peripheral edge coupled between said peripheral edge of said tube bottom and said peripheral edge of said collecting box; and a plurality of flat tubes soldered to said plurality of openings in said intermediate bottom.

8. The heat exchanger of claim 7 wherein said tube bottom further comprising a plurality of passages adapted to receive said plurality of flat tubes.

9. The heat exchanger of claim 7 further comprising a plurality of intermediate connections.

10. A heat exchanger for enabling the flow of a heat exchanging medium, said heat exchanger comprising:

a collecting box having a peripheral edge;

a tube bottom having a peripheral edge and a plurality of openings, said peripheral edge of said tube bottom being coupled to said peripheral edge of said collecting box;

an intermediate bottom having a plurality of openings and a peripheral edge, said peripheral edge coupled to said peripheral edge of said tube bottom; and a plurality of flat tubes soldered to said plurality of openings in said intermediate bottom.

11. The heat exchanger of claim 1 further comprising a seal between said collecting box and said tube bottom.

12. A heat exchanger for enabling the flow of a heat exchanging medium, said heat exchanger comprising:

a collecting box having a peripheral edge;

a tube bottom having a peripheral edge and a plurality of openings said peripheral edge of said tube bottom being coupled to said peripheral edge of said collecting box;

an intermediate bottom having a plurality of openings and a peripheral edge, said peripheral edge coupled to said peripheral edge of said tube bottom; and a plurality of flat tubes coupled to said plurality of openings in said intermediate bottom;

wherein said plurality of openings of said tube bottom are adapted to receive a plurality of flat tubes having a first major dimension.

13. The heat exchanger of claim 12 wherein said plurality of openings of said intermediate bottom are adapted to receive a plurality of flat tubes having a second major dimension different from said first major dimension.

14. A heat exchanger for enabling the flow of a heat exchanging medium, said heat exchanger comprising:

a collecting box having a peripheral edge;

a tube bottom having a peripheral edge and a plurality of openings, said peripheral edge of said tube bottom being coupled to said peripheral edge of said collecting box;

an intermediate bottom having a plurality of openings and a peripheral edge, said peripheral edge coupled to said peripheral edge of said tube bottom;

a plurality of flat tubes coupled to said plurality of openings in said intermediate bottom; and a space between said tube bottom and said intermediate bottom, said space containing said heat exchanging medium.

15. A heat exchanger for enabling the flow of a heat exchanging medium, said heat exchanger comprising:

a collecting box having a peripheral edge;

a tube bottom having a peripheral edge and a plurality of openings, said peripheral edge of said tube bottom being coupled to said peripheral edge of said collecting box;

an intermediate bottom having a plurality of openings and a peripheral edge, said peripheral edge coupled to said peripheral edge of said tube bottom; and a plurality of flat tubes coupled to said plurality of openings in said intermediate bottom;

wherein said tube bottom comprises a trough receiving said peripheral edge of said collector box.

16. A heat exchanger for enabling the flow of a heat exchanging medium, said heat exchanger comprising:

a collecting box having a peripheral edge;

a tube bottom having a peripheral edge and a plurality of openings, said peripheral edge of said tube bottom being coupled to said peripheral edge of said collecting box;

an intermediate bottom having a plurality of openings and a peripheral edge, said peripheral edge coupled to said peripheral edge of said tube bottom; and a plurality of flat tubes coupled to said plurality of openings in said intermediate bottom;

wherein said peripheral edge of said intermediate bottom is soldered to a vertical portion of said trough of said tube bottom.

17. A heat exchanger for enabling the flow of a heat exchanging medium, said heat exchanger comprising:

a collecting box having a peripheral edge;

a tube bottom having a peripheral edge and a plurality of openings, said peripheral edge of said tube bottom being coupled to said peripheral edge of said collecting box;

an intermediate bottom having a plurality of openings and a peripheral edge, said peripheral edge coupled to said peripheral edge of said tube bottom; and a plurality of flat tubes coupled to said plurality of openings in said intermediate bottom;

wherein said intermediate bottom is soldered to a bottom of said trough of said bottom.

18. A method of manufacturing a heat exchanger, said method comprising the steps of:

coupling a collecting box to a tube bottom;

coupling an intermediate bottom to said tube bottom; and soldering a plurality of flat tubes to said intermediate bottom.

19. A method of manufacturing a heat exchanger, said method comprising the steps of:

coupling a collecting box to a tube bottom;

coupling an intermediate bottom to said tube bottom;

coupling a plurality of flat tubes to said intermediate bottom; and providing a space between said tube bottom and said intermediate bottom which is occupied by a heat exchanging medium.

20. A method of manufacturing a heat exchanger, said method comprising the steps of:

coupling a collecting box to a tube bottom;

coupling an intermediate bottom to said tube bottom; and coupling a plurality of flat tubes to said intermediate bottom;

wherein said step of coupling a collecting box to said tube bottom comprises coupling a tube bottom having plurality of openings adapted to receive a plurality of flat tubes having a first major dimension, and wherein said step of coupling an intermediate bottom to said tube bottom comprises coupling an intermediate bottom having a plurality of openings which are adapted to receive a plurality of flat tubes having a second major dimension to said tube bottom.

* * * * *